United States Patent [19]

Biek

[11] Patent Number: 4,740,144

[45] Date of Patent: Apr. 26, 1988

[54] REVERSIBLE RADIAL VANE AIR MOTOR

[75] Inventor: Paul A. Biek, Houston, Tex.

[73] Assignee: Dresser Industries, Inc., Dallas, Tex.

[21] Appl. No.: 45,934

[22] Filed: May 4, 1987

[51] Int. Cl.[4] ..... F03C 2/00

[52] U.S. Cl. ..... 418/266; 418/270

[58] Field of Search ..... 418/270, 266, 40, 41, 418/42, 43, 44; 415/503; 173/163

[56] References Cited

U.S. PATENT DOCUMENTS

| | | | |
|---|---|---|---|
| 1,810,176 | 6/1931 | Hott | 418/270 |
| 2,257,892 | 10/1941 | Sittert et al. | 418/43 |
| 2,575,524 | 11/1951 | Mitchell | 418/270 |
| 3,429,230 | 2/1969 | Quackenbush | 418/270 |
| 4,040,311 | 8/1977 | Page, Jr. et al. | 415/503 |

*Primary Examiner*—Leonard E. Smith
*Assistant Examiner*—Leonard P. Walnoha

[57] ABSTRACT

The invention relates to a reversible radial vane air motor with manual speed control that is capable of attaining excellent forward horsepower. The invention includes a bypass air passage and an exhaust deflector that routes pressurized air through the backside of the motor when the motor is operated in reverse. A reverse control lever controls the flow of air through the bypass passage and opens a reverse exhaust passage. The motor may also be equipped with a centrifugal governor for controlling the flow of air in the forward operation with the governor being bypassed in reverse operation.

18 Claims, 2 Drawing Sheets

REVERSIBLE RADIAL VANE AIR MOTOR

TECHNICAL FIELD

This invention relates to a reversible air motor to be used in portable pneumatic tools such as a pneumatic drill or nutrunner. The motor is capable of achieving nearly the full horsepower of a "forward only" motor in a forward rotation. Pressurized air is routed through a bypass passage into the back of the motor through the forward exhaust. The motor provides fingertip control of the motor speed in a reverse mode.

BACKGROUND

Radial vane air motors, or pneumatic motors, are widely used in industry particularly in portable tools. The design of such motors has evolved over the years to an optimum geometry for both "forward only" and "reversible" types. The design of the reversible motors, however, provides limited horsepower in forward operation as compared with a "forward only" motor. For example, one type of reversible motor is a mirror image type that is capable of producing in a forward rotation only seventy to eighty-five percent as much horsepower as a "forward only" type motor with the same displacement.

Conventional reversible radial vane air motors have ports and passages that conduct all or a part of the exhaust air through a reversing valve located on the end plate of the motor or in a backhead adjacent to the motor. Incorporating a governor into reversible motors makes these passages more complex, and the forward horsepower is reduced even further by backpressure through the reversing valve and the ports and passages.

Horsepower in the forward direction of a reversible motor is often enhanced by non-symmetric placement of ports. This results in a reduction of horsepower in the reverse direction. Another means for increasing horsepower in the forward direction is to include complex and elaborate slides and valves, but these complex motors have proven impractical in portable air tools. Thus, a need existed for a reversible radial vane governed air motor that can be easily incorporated into a portable pneumatic tool and achieve near full horsepower in the forward direction.

SUMMARY OF THE INVENTION

The present invention provides a reversible radial vane air motor with manual speed control that is capable of nearly attaining the full forward horsepower of a "forward only" radial vane motor and providing greater horsepower in a forward operation than conventional reversible motors. The invention also provides means for utilizing a centrifugal speed governor in a forward rotation while bypassing it in a reverse rotation. Conventional types of reversing valves are not used, but rather, the invention provides a direct and unencumbered air conducting system for both forward and reverse operation of the motor.

The invention provides a reversible radial vane air motor that includes forward inlets and exhaust means, a reverse conducting means, a reverse exhaust means, and a reverse control means. In one embodiment of the invention, the reverse conducting means includes a bypass passage for conducting pressurized air from an external source to a rotor cavity of the motor such that the rotor is turned in reverse. An exhaust deflector acts to close the forward exhaust means and route the incoming air from the bypass passage into the rotor cavity. The reverse exhaust means includes a passage and an atmospheric exhaust valve. The reverse control means controls the flow of air in the bypass passage by variably opening a control valve. The reverse control means also variably controls the exhaust valve. During forward operation of the motor, both the reverse conducting means and the reverse exhaust means are closed to the flow of air.

In another embodiment of the invention, the motor is operated in reverse by first closing the air inlet means for forward operation. After the air supply to the motor is shut off, a reverse control lever is shifted from its forward position to a variable reverse position. This action actuates the reverse control means and opens the bypass air passage to the flow of air. The bypass passage allows the air to bypass air controls means for 10 forward operation of the motor. In one embodiment, these forward controls may include a throttle valve and a centrifugal governor. The exhaust deflector closes the forward exhaust means and routes the pressurized air in the bypass passage into the rotor cavity. The air flows in the opposite direction of the forward rotation thereby turning the rotor in reverse. The reverse air bypasses the forward air control means and exits the motor through a reverse air exhaust that is also opened by the shifting of the reverse control lever. When the reverse lever is returned to the forward position, the bypass passage is closed to the flow of air, the exhaust deflector is returned to its forward position, and the reverse exhaust is closed as the motor is returned to the forward operation mode.

BRIEF DESCRIPTION OF THE DRAWINGS

The foregoing and additional objects and advantages of the invention will be more apparent when the following Detailed Description is read in conjunction with the accompanying drawings, wherein like reference characters denote like parts in all views and wherein.

DETAILED DESCRIPTION

The present invention relates to a reversible air motor that has radial vanes. The invention provides manual means to reverse the motor and a unique means of routing the pressurized air through the motor in a reverse direction. The motor is so designed as to achieve nearly full horsepower in a forward rotation as a "forward only" motor and to provide manual speed control in a reverse rotation. The motor may include a centrifugal governor that governs the flow of air to the motor in a forward rotation but is bypassed in reverse operation. The invention may be used in almost any pneumatic tool and is particularly adapted for use in portable pneumatic tools.

Figure 1:
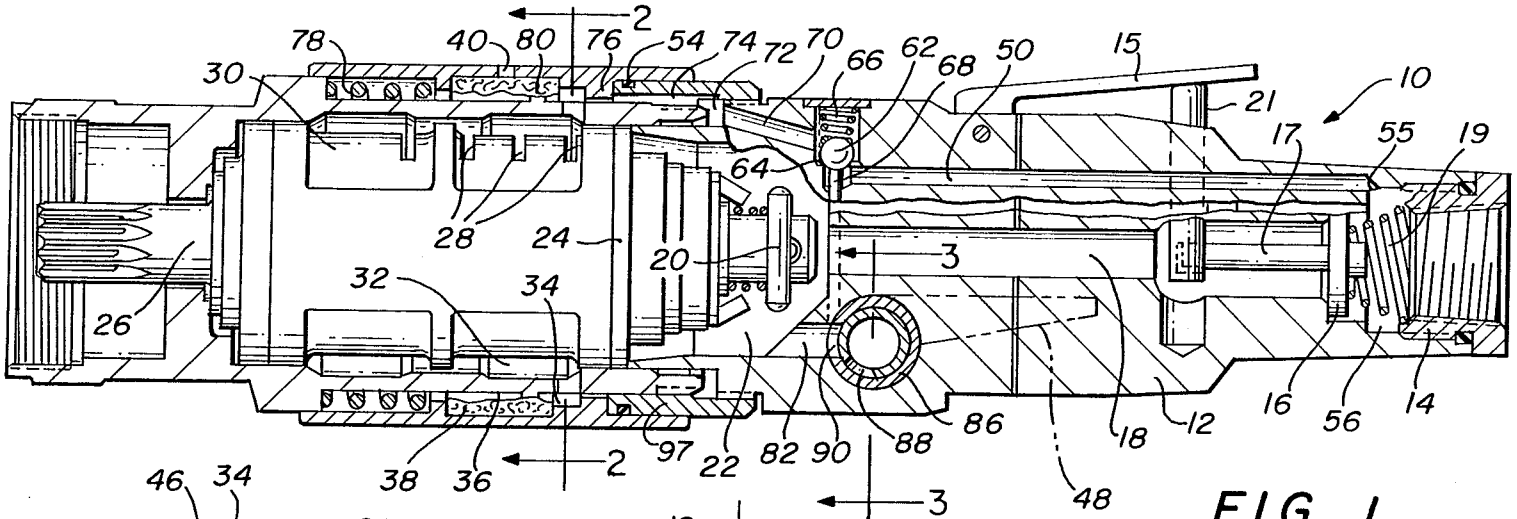
FIG. 1 is a cutaway view of one embodiment of the invention.

Referring to the drawing, FIG. 1 shows a partial cutaway and cross-sectional view of one embodiment of the invention. A reversible motor 10 is included within a housing 12. For forward operation, pressurized air enters an inlet bushing 14 from an external source and flows through a tiltable throttle valve 16 (shown closed in FIG. 1). Tiltable throttle valve 16 is operated by a throttle lever 15 which acts on push rod 21 which is engaged with lever arm 17 to tilt open throttle valve 16 against a compression throttle spring 19. As throttle valve 16 is opened, pressurized air flows through inlet passage 18, past a centrifugal governor 20 (shown open) and into cavity 22. The pressurized air then flows into a slot in rear end plate 24, enters a rotor cavity 25 (shown in FIG. 2) and turns rotor 26 in a forward direction. The spent air is then exhausted through slots 28 in motor cylinder 30 into annular cavity 32. The air is then routed through radial holes 34 into muffler cavity 36, through muffler element 38 and vented to the atmosphere through atmospheric exhaust slots 40.

Figure 2:
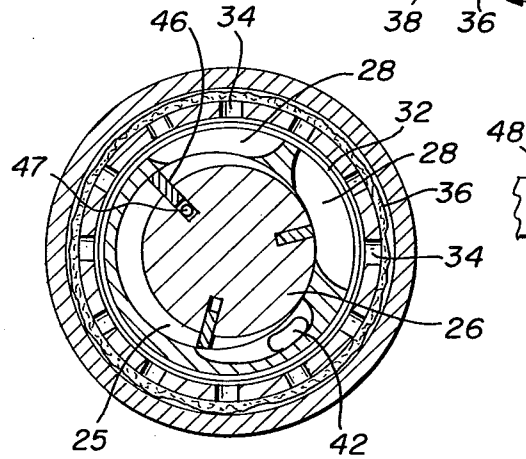
FIG. 2 is a cross-sectional view along line 2—2 showing the interior of the motor in FIG. 1.

FIG. 2 illustrates the inner workings of motor 10 and the relation of the inlet and exhaust air slots. For forward operation of the motor, pressurized air enters through inlet port 42 into rotor cavity 25. The air pushes on radial vanes 46 such that the rotor 26 turns in a clockwise rotation as viewed in FIG. 2, and the air exhausts through slots 28, cavity 32, radial holes 34, muffler cavity 36 and out atmospheric exhaust slots 40 (not shown in the cross-sectional view of FIG. 2). This configuration provides a reversible radial vane motor with good horsepower and air efficiency in the forward direction.

To operate the motor in reverse, the tiltable throttle valve 16 must be closed. This may be accomplished as shown in FIG. 1 by releasing throttle lever 15 and allowing throttle spring 19 to close throttle valve 16. This shuts off the flow of air through inlet passage 18 to the motor, thereby stopping the forward rotation of the rotor 26.

Figure 4:
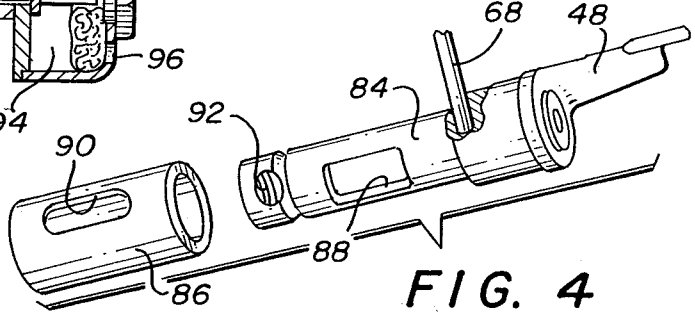
FIG. 4 is an exploded view of the reverse lever.

In one embodiment of the invention, the motor is operated in the reverse mode by shifting lever 48, shown in phantom lines in FIG. 1 and shown in an exploded view in FIG. 4, to the reverse position. This results in several things happening. First, it opens the bypass air passage 50 to the flow of pressurized air. Passage 50 receives the incoming pressurized air through an opening 55 from cavity 56 which is located on the feed side of throttle valve 16. Opening 55 is always open to receive incoming air, but in the forward operation of the motor, passage 50 is closed by a ball valve 62 which is held against seat 64 by a compression spring 66. The ball valve 62 also controls the flow of air through passage 50 in reverse operation of the motor. When the lever 48 is shifted to the reverse position, lift pin 68, which is attached to lever 48, forces ball 62 against spring 66 and opens passage 50. Incoming pressurized air flows from inlet cavity 56 through passage 50, past ball 62 and into passage 70. The air in passage 70 then flows through annular passage 72 and into deflector cavity 74. In a preferred embodiment of the invention, pressurized air in cavity 74 imposes a force against a pressure-actuated exhaust deflector 76 which is slidably mounted on motor housing 12. The exhaust deflector 76 is forced by the pressurized air in cavity 74 against a compression spring 78, until the deflector stops against a circumferential ridge 80 on the motor housing 12. The exhaust deflector may be actuated by means other than the air pressure in cavity 74, such as by a valve or switch.

As the exhaust deflector 76 slides up against the ridge 80, it closes off the atmospheric exhaust route used for forward rotation. A portion of deflector 76 is positioned to block the flow of air from radial holes 34 to muffler cavity 36. The incoming pressurized air in deflector cavity 74 is routed by deflector 76 from cavity 74 through the radial holes 34 to annular cavity 32. The pressurized air enters the rotor cavity 25 through slots 28 and drives the rotor 26 in a reverse direction (counterclockwise as shown in FIG. 2), causing the motor to run in reverse. A suitable method must be used to "kick-out" the rotor vanes 46, such as spring-means 47. The expended air is then exhausted from rotor cavity 25 through port 42, the rear end plate 24 and into cavity 22.

Figure 3:
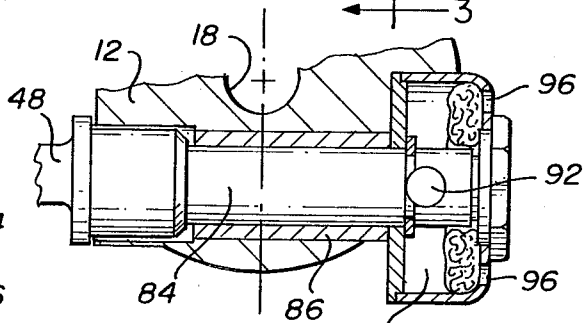
FIG. 3 is a cross-sectional view along line 3—3 showing one embodiment of the reverse air exhaust.

Shifting lever 48 to the reverse position also opens a reverse exhaust port, thereby allowing air to flow from cavity 22 through passage 82 and out of the motor housing 12. In a preferred embodiment, as lever 48 is shifted to the reverse position, a rotary valve 84 rotates inside bushing 86 to match up the openings 88 and 90 in the valve 84 and the bushing 86 respectively. These are illustrated in an exploded fashion in FIG. 4. FIG. 3 shows a cross-sectional view along line 3—3 of the reverse air exhaust system showing the rotary valve 84 inside bushing 86. In reverse mode, the air in cavity 22 is exhausted through passage 82, through openings 88 and 90 into the interior of valve 84. The air is then vented through an exhaust hole 92 in valve 84 into muffler cavity 94 and out slots 96 to the atmosphere. In forward operation of the motor, this reverse exhaust is shut off by the positioning of control lever 48 in the forward position which does not create any opening through valve 84 since the openings 88 and 90 are not matched up.

The speed of the motor in reverse can be controlled with lever 48. As lever 48 is shifted to reverse mode, lift pin 68 forces ball 62 against spring 66, thereby opening the passage 50 to the flow of incoming pressurized air. The range of movement on lever 48 is variable and controls the flow of air through passage 50 and the motor speed in reverse by variably forcing ball 62 against spring 66 through lift pin 68 to allow air to flow through passage 50 in the reverse operation of the motor.

When lever 48 is released from a reverse mode position, spring 66 forces ball 62 back against seat 64 thereby closing the reverse air passage 50 and shutting off the flow of reverse air to the motor 10. Spring 66 also forces lift pin 68 down on lever 48 thereby returning lever 48 to its forward mode position. This also causes valve 84 to rotate within bushing 86 to a closed position thereby closing the reverse exhaust through passage 82. As the reverse air flow through passage 50 into cavity 74 is cut off, spring 78 forces exhaust deflector 76 back to its forward mode position, thereby opening the forward exhaust through holes 34, cavity 36 and slots 40. Thus, with the return of lever 48 to the forward mode position, all other components are returned to readiness for forward operation of the motor.

The embodiment of the present invention shown in FIG. 1 includes a turnbuckle collar 97 that contains deflector cavity 74. The collar 97 has an internal right-hand thread and an internal left-hand thread allowing the motor backhead to be oriented in any rotational position while orienting the motor into the motor housing 12.

Figure 5:
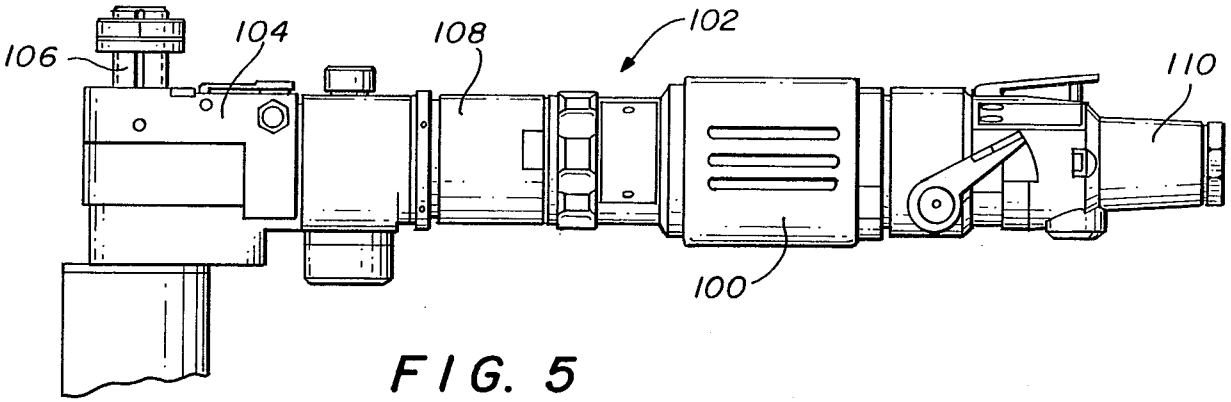
FIG. 5 shows the motor incorporated into a pneumatic drill.
Figure 6:
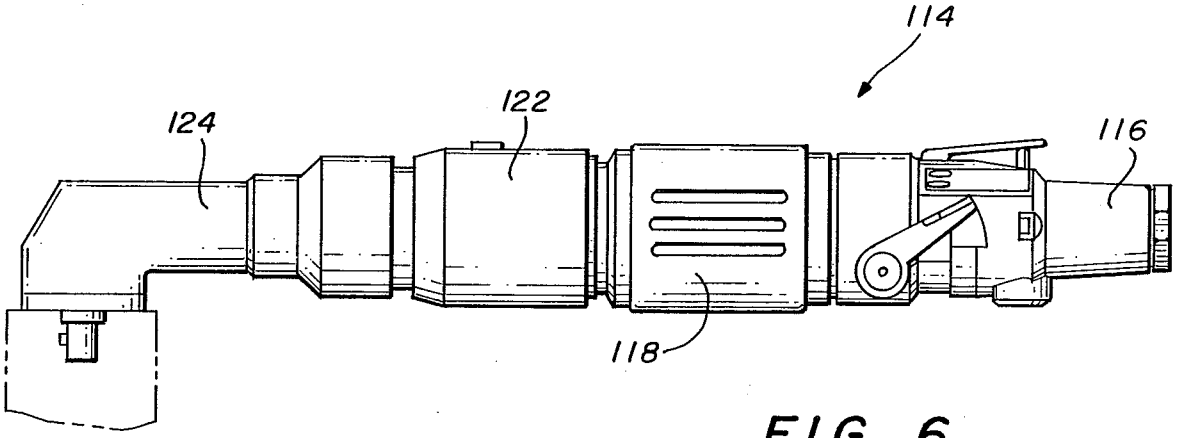
FIG. 6 shows the motor incorporated within a nutrunner.

The reversible motor of the present invention can be used in almost any pneumatic tool. It is particularly adapted for use in a portable pneumatic tool such as a drill or nutrunner. FIG. 5 shows the motor 100 of the present invention incorporated within an automatic positive feed drill 102, although it would be capable of use in any type of drill. The drill 102 includes a drill head 104, a spindle 106, a gear section 108 and an air inlet 110. Similarly, FIG. 6 shows the motor of the present invention incorporated into a nutrunner 114. The nutrunner 114 includes air inlet 116, motor 118, transmission section 122 and tool attachment 124.

From the foregoing Detailed Description, it is apparent that the invention describes a reversible air motor with radial vanes that is designed to achieve nearly the same horsepower in a forward rotation as a "forward-only" type of air motor. The invention also provides for manual control of the motor speed in a reverse rotation. Having described but one embodiment of the invention, it will be apparent to those skilled in the art that there may be many changes and modifications to the invention without departing from the spirit and scope of the invention. In particular, automatic controls may replace the manually operated lever to control the operation of the motor in reverse mode.

What I claim is:

1. A reversible air motor comprising:

a motor housing;

a motor cylinder contained within the motor housing; said cylinder having a rotor cavity;

a rotor positioned within the rotor cavity, said rotor having radial slots;

radial vanes positioned in said slots;

forward air inlet means for conducting air from an external source to the rotor cavity, said inlet means including a main air passage contained within the housing connecting the external source to the rotor cavity;

forward exhaust means for exhausting air from the rotor cavity to the atmosphere, said exhaust means having a passage connecting the rotor cavity to an atmospheric exhaust port located on the housing;

reverse conducting means for conducting pressurized air from an external source to the rotor cavity, said reverse conducting means including a bypass passage contained within the motor housing that connects an external source of pressurized air to the forward exhaust means, and also including an exhaust deflector slidably mounted on the housing, said exhaust deflector acting to close the forward exhaust port and route the air in the bypass passage through the forward exhaust means and into the rotor cavity when the motor is operated in a reverse mode;

reverse control means for controlling the flow of air through the reverse conducting means, said reverse control means having first means located in the bypass passage for controlling the flow of air through the passage and said first means operably engaged with a second means, a portion of said second means located external to the housing, said reverse control means closing said reverse conducting means to the flow of air when the motor is in a forward operation mode and opening said reverse conducting means to the flow of air when the motor is in a reverse operation mode; and reverse exhaust means for exhausting air from the rotor cavity to the atmosphere when the motor is operating in a reverse mode, said reverse exhaust means having an exhaust passage connecting the rotor cavity with a reverse exhaust port located on the housing and being operably engaged with said reverse control means, said reverse exhaust means being closed when the motor is in a forward operation mode and being opened by said reverse control means when the motor is in a reverse operation mode.

2. The reversible air motor of claim 1 wherein the exhaust deflector is pressure-actuated by the air in the bypass passage.

3. The reversible air motor of claim 1 wherein the reverse control means comprises a ball valve acting against a spring, said ball valve being positioned within the bypass passage to control the flow of air through the passage.

4. The reversible air motor of claim 3 wherein the reverse control means also includes a lift pin attached to a reverse control lever, a portion of said control lever protruding external to the motor housing, said lift pin being positioned so as to force said ball against said spring to open the bypass passage to the flow of air, and said lift pin being variably positioned by the variable movement of said reverse control lever.

5. The reversible air motor of claim 1 wherein the reverse exhaust means includes a rotary valve positioned within said exhaust passage and wherein the reverse control means includes a reverse control lever, a portion of said lever protruding external to the motor housing, said rotary valve being operably engaged with the reverse control lever such that variable movement of said lever variably opens said rotary valve.

6. The reversible air motor of claim 4 wherein the reverse exhaust means includes a rotary valve positioned within said exhaust passage and operably connected to said reverse control lever.

7. The reversible air motor of claim 1 further comprising a centrifugal governor positioned in the forward air inlet means, said governor controlling the motor speed in a forward operation by controlling the flow of air to the motor, but said governor being bypassed by said reverse conducting means and said reverse exhaust means when the motor is operated in reverse.

8. The reversible air motor of claim 1 further comprising said rotor vanes including spring means for forcing the vanes out from the rotor.

9. A reversible air motor comprising:

a motor housing;

a motor cylinder within the motor housing having a rotor cavity and passages for admitting air to and exhausting air from the rotor cavity;

a rotor positioned within the rotor cavity, said rotor having radial slots;

radial vanes slidably engaged in said radial slots;

forward air inlet means having a main air passage within the housing and connections to the rotor cavity for conducting pressurized air from an external source to the rotor cavity such that the pressurized air turns the rotor in a forward direction during forward operation of the motor;

forward exhaust means for conducting exhaust air from the rotor cavity to the atmosphere during forward operation of the motor, said forward exhaust means having a forward exhaust passage connecting the rotor cavity with a forward exhaust port located on the housing;

forward air control means for controlling the flow of air through the forward air inlet means, said forward air control means located within said main air passage;

a bypass air passage contained within the motor housing for conducting pressurized air from an external source to the rotor cavity such that the air turns the rotor in a reverse direction, said bypass passage conducting the air such that it bypasses the forward air inlet means and the forward air control means;

reverse air control means for controlling the flow of air through the bypass air passage, said reverse control means having a first means located within the bypass air passage and a second means located partially external to the motor housing, said first means operably engaged with said second means, and said reverse air control means closing the bypass passage during forward operation and variably opening the passage during reverse operation;

an exhaust deflector slidably mounted on the motor housing and positioned such that it is capable of sliding into a position to close off the forward exhaust port during reverse operation of the motor;

reverse exhaust means for conducting exhaust air from the rotor cavity to the atmosphere during reverse operation of the motor, said reverse exhaust means having an exhaust passage and a reverse exhaust port being closed during forward operation; and a reverse control lever that has a forward mode position and variable reverse mode positions, said control lever located partially external to the housing and being operably engaged with the reverse air control means and the reverse exhaust means to allow for variable control of the reverse air control means and the reverse exhaust means.

10. The reversible air motor of claim 9 wherein the forward air control means includes a centrifugal governor located in the main air passage and wherein the reverse exhaust means conducts the exhaust air so as to bypass the centrifugal governor during reverse operation of the motor.

11. The reversible air motor of claim 9 wherein the forward air control means includes a tiltable throttle valve.

12. The reversible air motor of claim 9 wherein the reverse air control means includes a ball valve acting against a compression spring.

13. The reversible air motor of claim 12 wherein the reverse control lever is operably engaged with the ball valve by a lift pin attached to said control lever and positioned such that when said control lever is shifted to a reverse mode position said lift pin forces the ball valve against said spring and opens the bypass passage to the flow of air.

14. The reversible air motor of claim 9 wherein the exhaust deflector is pressure-actuated by the air pressure in the bypass passage so as to slide on the housing to cover the forward exhaust port.

15. The reversible air motor of claim 9 wherein the reverse exhaust means includes a rotary valve positioned within the reverse exhaust passage and attached to the reverse control lever such that when the control lever is shifted to a reverse mode position said rotary valve opens to allow air to exhaust to the atmosphere.

16. The reversible air motor of claim 13 wherein the reverse exhaust means includes a rotary valve attached to the reverse control lever.

17. The reversible air motor of claim 9 further comprising means for returning the exhaust deflector, the reverse air control means, and the reverse exhaust means to their forward operation positions when the reverse control lever is shifted to the forward mode position.

18. A reversible air motor comprising:

a motor housing;

a motor cylinder within the motor housing having a rotor cavity, a forward inlet port for admitting pressurized air into the rotor cavity during forward operation of the motor, and forward exhaust ports for exhausting air from the rotor cavity during forward operation of the motor;

a rotor with radial vanes within the rotor cavity;

a main air passage contained within the motor housing for conducting pressurized air from an external source to the forward inlet port of the cylinder during forward operation;

a tiltable throttle valve located within the main air passage for controlling the flow of air through the main air passage, said throttle valve being closed during reverse operation of the motor;

a centrifugal governor positioned in said main air passage so as to govern the flow of air to the motor during forward operation of the motor;

a forward exhaust passage for conducting air from the forward exhaust ports of the cylinder to the atmosphere during forward operation of the motor;

a bypass air passage contained within the motor housing for conducting pressurized air from an external source to the forward exhaust ports of the cylinder during reverse operation of the motor, bypassing the throttle valve, the main air passage and the centrifugal governor;

a ball valve located in the bypass air passage that controls the flow of air through the bypass air passage, said ball valve being held closed by a spring during forward operation thereby closing said bypass passage to the flow of air during forward operation of the motor;

a lift pin located within the housing and positioned so as to force the ball against said spring and open the bypass passage to the flow of air during reverse operation of the motor;

a pressure-actuated exhaust deflector slidably engaged with the motor housing and positioned partially within the bypass air passage such that air pressure within said bypass passage forces the exhaust deflector against a spring for moving the exhaust deflector to a position such that the deflector closes off the forward exhaust passage to the atmosphere and routes the air in the bypass passage into the rotor cavity;

a reverse exhaust passage contained within the motor housing for conducting air from the rotor cavity to the atmosphere during reverse operation of the motor;

a rotary valve positioned within the reverse exhaust passage so as to control the flow of air through the passage; and a reverse control lever operably engaged with the rotary valve and positioned such that a portion of the reverse control lever is external to the motor housing, said control lever also being operably engaged with the lift pin such that variable movement of the control lever forces the lift pin against the ball valve thereby variably controlling the flow of air in the bypass passage, such variable movement of said control lever also variably opens the rotary valve allowing air to flow through the reverse exhaust passage.

* * * * *